United States Patent [19]

Desjardins

[11] Patent Number: 4,890,807

[45] Date of Patent: Jan. 2, 1990

[54] LIQUID TOOL CADDY

[76] Inventor: Warren Desjardins, 18 Bonita Rd., East Quogue, N.Y. 11942

[21] Appl. No.: 258,010

[22] Filed: Oct. 14, 1988

[51] Int. Cl.[4] ..... A47G 23/02

[52] U.S. Cl. ..... 248/146; 220/20; 220/69; 220/90; 248/176; 248/346

[58] Field of Search ..... 248/146, 127, 176, 346, 248/678; 220/20, 69, 70, 90

[56] References Cited

U.S. PATENT DOCUMENTS

| | | | |
|---|---|---|---|
| 1,101,289 | 6/1914 | Jones | 220/69 X |
| 1,408,253 | 2/1922 | Blank | 248/146 X |
| 2,751,177 | 6/1956 | York | 248/146 |
| 3,520,505 | 7/1970 | Allen | 248/146 |
| 3,688,939 | 9/1972 | Beckers | 220/69 X |
| 4,068,760 | 1/1978 | Johnson, Jr. | 220/20 W X |
| 4,266,686 | 5/1981 | Carter | 220/90 |
| 4,436,217 | 3/1984 | Ritter | 220/90 X |

*Primary Examiner*—Ramon O. Ramirez
*Attorney, Agent, or Firm*—Richard L. Miller

[57] ABSTRACT

This caddy is designed to be employed by painters and interior decorators. Primarily, it consists of a hollow base with an opening in a side for insertion of a sponge or cloth, and a container for liquids includes a bottom wall that snappingly engages with a rim of the base. A tool support device is also provided and engages with an upper rim of the container, the device includes a serrated edge for removing residue paint or other materials from tools as well as a scraper device for scraper for scraping walls etcetera.

4 Claims, 1 Drawing Sheet

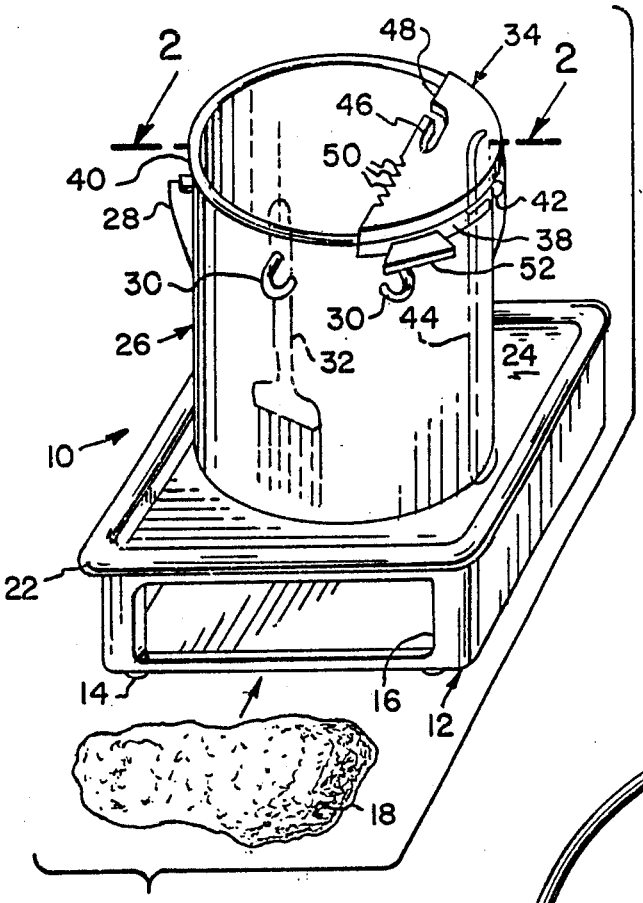
Fig. 1
Fig. 3
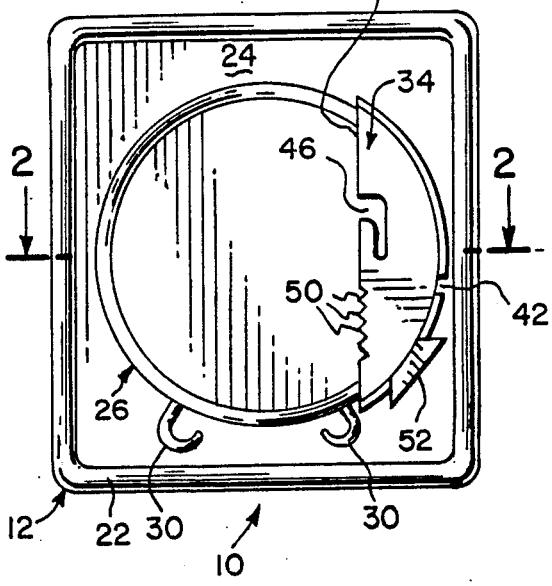
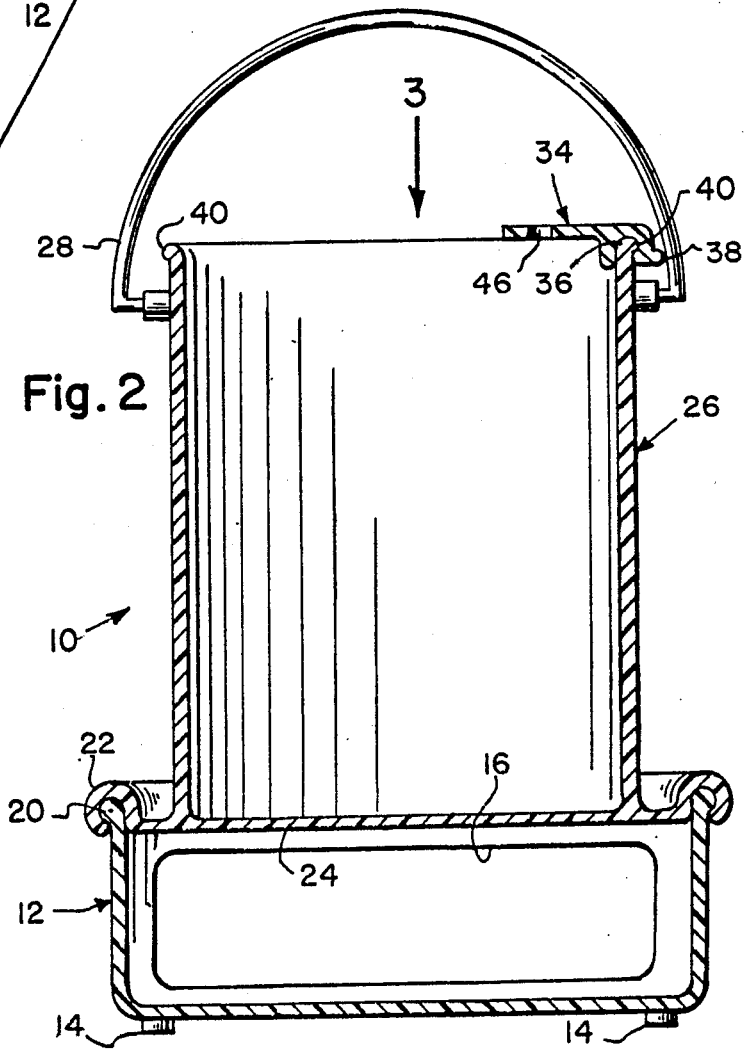
Fig. 2

LIQUID TOOL CADDY

BACKGROUND OF THE INVENTION

The instant invention relates generally to accessories for painters, and the like and more particularly, to a liquid tool caddy.

Numerous devices have been provided in the prior art that are adapted to be useful to painters, interior decorators, etc. While these units may be suitable for the particular purpose to which they address, they would not be as suitable for the purpose of the present invention as hereafter described.

SUMMARY OF THE INVENTION

A primary object of the present invention is to provide a liquid tool caddy that will overcome the shortcomings of the prior art devices.

Another object is to provide a liquid tool caddy that will be of such design, as to have a removable container for liquids, a base for storage of sponges, and a tool support device.

An additional object is to provide a liquid tool caddy that will have hooks for the support of brushes, and the support device will also have slots for the support of articles, and a scraper will be provided on the support device.

A further object is to provide a liquid tool caddy that is simple and easy to use.

A still further object is to provide a liquid tool caddy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention;

FIG. 2 is a cross sectional view taken on line 2—2 in FIG. 1;

FIG. 3 is a fragmentary top view taken in the direction of arrow 3 in FIG. 2.

DETAILED DESCRIPTION OF THE PREFERRED EMBODIMENTS

Turning now descriptively to the drawings, in which like reference characters denote like elements throughout the several views, a caddy 10 is shown to include a hollow plastic base 12 having support legs 14 fixedly secured to the bottom, and an opening 16 is provided in one side of base 12, for the reception of a sponge 18 or other article. A beaded lip 20 is provided on the upper open end of base 12 and snappingly engages with the interior of a channel rim 22 integrally attached on the edges of a bottom wall 24 of a container 26.

Bottom wall 24 is integrally attached to container 26, and 24 and 26 are of a suitable plastic material. A typical handle 28 is pivotally secured to container 26 for easy carrying of caddy 10, and a pair of spaced apart plastic hooks 30 are fixedly secured to the outside of container 26, for frictionally gripping a brush handle 32.

A tool support device 34 is provided and an opening 36 in the bottom of an arcuate rim 38, snappingly engages with an annular beaded upper rim 40 on the open end of the container 26. A slot 42 is provided through the rim 38 and frictionally receives a stirring stick 44 shown in phantom in FIG. 1. An L-shaped opening 46 is provided in edge 48 of support device 34, and can be used to clean a paint stirrer as well as for retaining a brush handle 32 or other article (not shown). Serration 50 are also provided in the edge 48 for removing residue material liquid from a tool, such as a brush, and a scraper 52 is fixedly secured and projecting from rim 38 of device 34.

In use, caddy 10 is carried to any desired area by the attached handle 28, and the hooks 30 are employed to hold brush handles 32 until they are to be used. The tool support device 34 is pulled away from engagement with rim 40 when it is desired to employ same for scraping with scraper 52, the device 34 may also be pulled away for ease of cleaning.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A liquid tool caddy, which comprises;

(a) a base, for storage of articles such as sponges or cloths;

(b) a container received on said base, for placement of liquids and supporting brushes;

(c) a tool support device removably secured to said container; and (d) means for holding said container to said base, wherein a side opening is provided through said base and provides entry for said articles, and said means comprises a beaded lip provided on an upper end of said base that snappingly engages an interior of a channel rim on a bottom wall of said container, and said channel rim is integrally attached to said bottom wall and said bottom wall is integrally attached to said container.

2. A liquid tool caddy as set forth in claim 1, wherein a handle is pivotally secured to said container and provides hand lifting means for both said container and said base, and a pair of resilient and spaced apart hooks are fixedly secured to an outer periphery of said container for frictionally receiving said brushes.

3. A liquid tool caddy as set forth in claim 2, wherein said tool support device seats on a portion of an open end of said container and is provided with an arcuate rim having an opening that snappingly engages with a second beaded rim provided and integrally attached to said container, and openings are provided in said support device that frictionally receive tools.

4. A liquid tool caddy as set forth in claim 2, wherein said support device further includes a straight edge with seration for scraping tools, and a projecting scraper is fixedly secured to said arcuate rim for scraping surfaces when said support device is disengaged from said container.

* * * * *